US009388690B2

(12) United States Patent
Kawai et al.

(10) Patent No.: US 9,388,690 B2
(45) Date of Patent: Jul. 12, 2016

(54) TUNNEL EXCAVATION METHOD

(71) Applicant: KOMATSU LTD., Tokyo (JP)

(72) Inventors: Kazunari Kawai, Kawasaki (JP); Shinichi Terada, Kawasaki (JP); Yuuichi Kodama, Hiratsuka (JP); Masaaki Uetake, Kawasaki (JP); Hiroshi Asano, Kobe (JP); Takashi Minami, Nishinomiya (JP); Junya Tanimoto, Kyoto (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/394,586

(22) PCT Filed: Jun. 5, 2013

(86) PCT No.: PCT/JP2013/065553

§ 371 (c)(1),
(2) Date: Oct. 15, 2014

(87) PCT Pub. No.: WO2014/010339

PCT Pub. Date: Jan. 16, 2014

(65) Prior Publication Data

US 2015/0069815 A1 Mar. 12, 2015

(30) Foreign Application Priority Data

Jul. 9, 2012 (JP) ..... 2012-153530

(51) Int. Cl.
*E21D 9/01* (2006.01)
*E21D 9/11* (2006.01)
(Continued)

(52) U.S. Cl.
CPC ..... *E21D 9/1093* (2013.01); *E21D 9/008* (2016.01); *E21D 9/01* (2016.01); *E21D 9/1006* (2013.01); *E21D 9/112* (2013.01); *E21D 9/14* (2013.01); *E21F 17/00* (2013.01)

(58) Field of Classification Search
CPC . E21D 9/007; E21D 2009/008; E21D 9/1093; E21D 9/11; E21D 9/112; E21D 9/14; E21C 29/02
See application file for complete search history.

(56) References Cited

U.S. PATENT DOCUMENTS 3,963,080 A * 6/1976 Walker ..... E21D 9/112 175/61
4,217,067 A 8/1980 Lagodka et al.
(Continued)

FOREIGN PATENT DOCUMENTS

CA 1081976 A 7/1980
CA 2 708 373 A1 6/2009
(Continued)

OTHER PUBLICATIONS

The International Search Report for the corresponding international application No. PCT/JP2013/065553, issued on Jul. 2, 2013.
(Continued)

*Primary Examiner* — John Kreck
*Assistant Examiner* — Michael Goodwin
(74) *Attorney, Agent, or Firm* — Global IP Counselors, LLP

(57) ABSTRACT

This tunnel excavation method includes a step of excavating three first tunnels that are substantially parallel to each other in a first excavation step. Second tunnels are excavated that intersect the first tunnels in a second excavation step. A boring machine is used that performs excavation in a state in which a gripper pushes against the side wall of the tunnel.

9 Claims, 14 Drawing Sheets

(51) Int. Cl.

| | |
|---|---|
| ***E21D 9/14*** | (2006.01) |
| ***E21D 9/10*** | (2006.01) |
| ***E21F 17/00*** | (2006.01) |

(56) References Cited

U.S. PATENT DOCUMENTS

| | | | | |
|---|---|---|---|---|
| 4,747,730 | A | 5/1988 | Urschitz | |
| 5,634,692 | A | 6/1997 | Kaneko et al. | |
| 2002/0031403 | A1 | 3/2002 | Konda et al. | |
| 2015/0078831 | A1* | 3/2015 | Kawai | E21D 9/10 405/139 |

FOREIGN PATENT DOCUMENTS

| | | | |
|---|---|---|---|
| CN | 1327120 | A | 12/2001 |
| CN | 1381669 | A | 11/2002 |
| CN | 1532373 | A | 9/2004 |
| JP | 3-5600 | A | 1/1991 |
| JP | 8-226294 | A | 9/1996 |
| JP | 2000-303775 | A | 10/2000 |
| JP | 2002-106289 | A | 4/2002 |
| JP | 2002-364286 | A | 12/2002 |

OTHER PUBLICATIONS

Office Action for the related Canadian patent application No. 2,871,420, issued on Nov. 16, 2015.

The Office Action for the corresponding Chinese application No. 201380026346.2, issued on Sep. 2, 2015.

The Office Action for the related Chinese application No. 23138003453.4, issued on Oct. 8, 2015.

The Office Action for the related U.S. Appl. No. 14/394,538, issued on Apr. 5, 2016.

* cited by examiner step S2 step S1 step S4 step S3 step S6 step S5 step S8 step S7

TUNNEL EXCAVATION METHOD

CROSS-REFERENCE TO RELATED APPLICATIONS

This application is a U.S. National stage application of International Application No. PCT/JP2013/065553, filed on Jun. 5, 2013. This U.S. National stage application claims priority under 35 U.S.C. §119(a) to Japanese Patent Application No. 2012-153530, filed in Japan on Jul. 9, 2012, the entire contents of which are hereby incorporated herein by reference.

BACKGROUND

Field of the Invention

The present invention relates to a tunnel excavation method in which intersecting tunnels are excavated.

In the past, tunnels have been excavated using a boring machine comprising a cutter head that includes a cutter on the machine front face, and grippers that are provided on the left and right sides at the rear of the machine.

This boring machine excavates a tunnel by snugly pushing the cutter head against the wall while rotating it, in a state in which the left and right grippers push against the left and right side walls of the tunnel.

For example, Japanese Laid-Open Patent Application H3-5600 (laid open Jan. 11, 1991 discloses a method for constructing the branching and merging parts of a sealed tunnel, including a step of using this boring machine to excavate the branched portions of the tunnel.

SUMMARY

However, the following problem was encountered with the above-mentioned conventional method for constructing the branching and merging parts of a sealed tunnel.

Specifically, with the tunnel excavation method disclosed in the above publication, in the excavation of branching and merging parts, the boring machine has to be moved back and forth over and over while excavating the branching and merging parts, which is extremely time-consuming and results in lower construction efficiency.

It is an object of the present invention to provide a tunnel excavation method with which the branching portions of a tunnel can be excavated more efficiently.

The tunnel excavation method pertaining to a first exemplary embodiment of the present invention is a tunnel excavation method in which a tunnel is excavated using a boring machine that performs excavation by rotating a cutter head in a state in which a gripper pushes against a side wall, the method comprising a first excavation step and a second excavation step. In the first excavation step, three or more first tunnels that are substantially parallel to each other are excavated. In the second excavation step, a second tunnel that intersects the first tunnel is excavated, and an auxiliary tunneling apparatus equipped with a reaction force receiver that forms a replacement face that becomes part of the side wall of the second tunnel is disposed on the first tunnel side at the intersection of the first and second tunnels.

Here, after the three or more first tunnels that are substantially parallel to each other have been excavated, second tunnels that intersect the first tunnels are excavated.

Consequently, because second tunnels that intersect the first tunnels are excavated after the three or more first tunnels that are substantially parallel to each other have been excavated, the second tunnels can be excavated as branches of the first tunnels by just excavation that is substantially linear. Thus, compared to a conventional tunnel excavation method, efficiency of the excavation work can be increased because almost all of the excavation is linear.

Furthermore, an auxiliary tunneling apparatus comprising a reaction force receiver that forms a replacement face that becomes part of the side wall of the second tunnel is installed on an existing first tunnel side to smoothly carry out the excavation of the intersection of the existing first tunnel and the newly excavated second tunnel by using a boring machine that performs excavation in a state in which left and right grippers push against the left and right side walls.

Consequently, a place where there is no side wall in the second tunnel, which occurs at portions intersecting with the existing first tunnel, can be blocked off by the replacement face of the reaction force receiver. Accordingly, an intersection between the first and second tunnels can be excavated using a conventional boring machine that excavates while receiving reaction force from the side walls.

The tunnel excavation method pertaining to a second exemplary embodiment of the present invention is the tunnel excavation method pertaining to the first exemplary embodiment of the present invention, further comprising a movement step of moving the auxiliary tunneling apparatus to another intersection of the first and second tunnels after excavation of an intersection of the first and second tunnels in the second excavation step.

Here, when there are a plurality of intersections between the first and second tunnels, the auxiliary tunneling apparatus is moved to each of these intersections.

Consequently, even when there are a plurality of intersections between the first and second tunnels, for example, the auxiliary tunneling apparatus can be moved efficiently to the intersections, and the excavation of the intersections can be carried out efficiently.

The tunnel excavation method pertaining to a third exemplary embodiment of the present invention is the tunnel excavation method pertaining to the first or second exemplary embodiments of the present invention, wherein, in the first excavation step, an auxiliary tunneling apparatus is disposed that comprises a corner-use reaction force receiver that forms a replacement face that becomes part of the outer side wall of a curved portion at which the first tunnel is curved.

Here, when a curved portion of the first tunnel is excavated, the auxiliary tunneling apparatus comprising a reaction force receiver for receiving the reaction force of the boring machine is installed at a location outside the curve.

Consequently, even when excavating a curved portion of the first tunnel, the excavation can proceed while the boring machine moves forward.

The tunnel excavation method pertaining to a fourth exemplary embodiment of the present invention is a tunnel excavation method in which a tunnel is excavated using a boring machine that performs excavation by rotating a cutter head in a state in which a gripper pushes against a side wall, the method comprising a first excavation step, a preparation step, a relocation step, and a second excavation step.

The first excavation step involves excavating a first tunnel. A second tunnel that intersects the first tunnel is planned to be excavated. The preparation step involves preparing a replacement face that becomes part of the side wall of the second tunnel at the planned intersection portion of the first tunnel and second tunnel. The relocation step involves relocating the replacement face to the planned intersection portion of the first tunnel, where it becomes part of the side wall of the second tunnel. The second excavation step involves excavating the second tunnel by using the boring machine, and pushing by the gripper against the replacement face and excavating at the planned intersection portion.

Consequently, since there is no need to construct a replacement face within the tunnel, a tunnel that intersects another tunnel can be constructed more easily than in the past.

The tunnel excavation method pertaining to a fifth exemplary embodiment of the present invention is the tunnel excavation method pertaining to the fourth exemplary embodiment of the present invention, wherein the first tunnel includes at least three sections that are substantially parallel to each other.

Here, there are a plurality of intersections between the first tunnel and the second tunnel. With the present invention, since the replacement face can be moved, the more intersections that have to be excavated, the more the construction efficiency can be improved over that of a conventional excavation method.

The tunnel excavation method pertaining to a sixth exemplary embodiment of the present invention is the tunnel excavation method pertaining to the fifth exemplary embodiment of the present invention, wherein the substantially parallel sections of the first tunnel are linked by curved sections, resulting in a continuous tunnel.

Consequently, because the first tunnel can be excavated merely by the forward advance of the boring machine, construction efficiency can be improved.

The tunnel excavation method pertaining to a seventh exemplary embodiment of the present invention is the tunnel excavation method pertaining to the fourth exemplary embodiment of the present invention, wherein the second tunnel includes at least three sections that are substantially parallel to each other.

Here, there are a plurality of intersections between the first tunnel and the second tunnel. With the seventh exemplary embodiment of the present invention, because the replacement face can be moved, the more intersections that have to be excavated, the more the construction efficiency can be improved over that of a conventional excavation method.

The tunnel excavation method pertaining to an eighth exemplary embodiment of the present invention is the tunnel excavation method pertaining to the seventh exemplary embodiment of the present invention, wherein the substantially parallel sections of the second tunnel are linked by curved sections, resulting in a continuous tunnel.

Consequently, because the second tunnel can be excavated merely by the forward advance of the boring machine, and because the replacement face is moved less often in the excavation of a plurality of intersections, construction efficiency can be improved.

DETAILED DESCRIPTION OF EXEMPLARY EMBODIMENTS

The auxiliary tunneling apparatus pertaining to an exemplary embodiment of the present invention, as well as the tunnel excavation method in which this apparatus is used, will now be described through reference to FIGS. 1 to 10B.

Figure 4B:
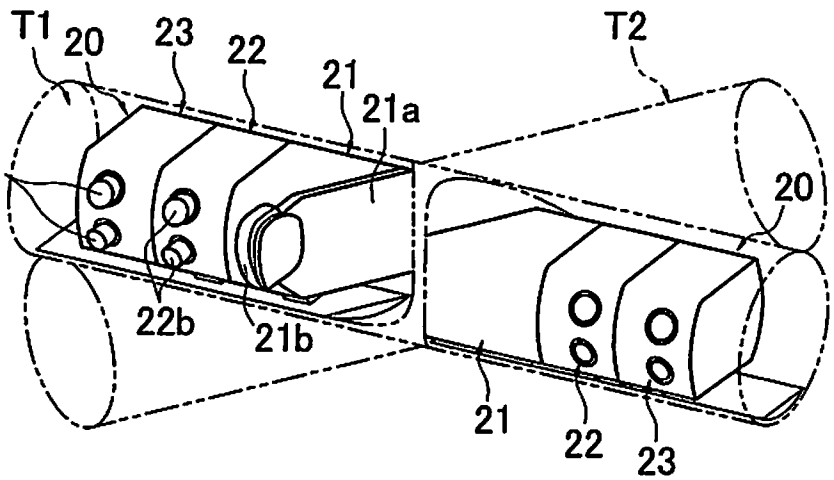
FIGS. 4A and 4B are a plan view and an oblique view of a state in which the auxiliary tunneling apparatus in FIG. 2 has been installed in a tunnel.

The boring machine 10 (FIG. 1, etc.) that appears in this exemplary embodiment is a TBM (tunnel boring machine), but more specifically is known as a gripper TBM or a hard rock TBM. In this exemplary embodiment, as shown in FIG. 4B, the tunnels (first and second tunnels T1 and T2) that are excavated with the boring machine 10 are both tunnels whose cross section is substantially circular. The cross sectional shape of the tunnel pertaining to the exemplary embodiments of the present invention is not limited to being circular, though, and may instead be elliptical, double circular, horseshoe shaped, or the like.

Configuration of Boring Machine 10

Figure 1:
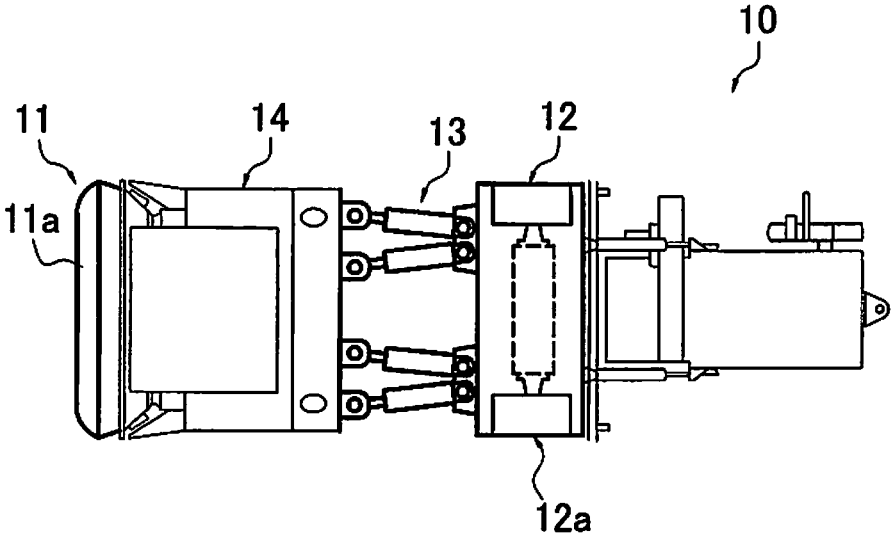
FIG. 1 is a side view of the configuration of a boring machine used in a tunnel excavation method featuring the auxiliary tunneling apparatus pertaining to an exemplary embodiment of the present invention.
Figure 2:
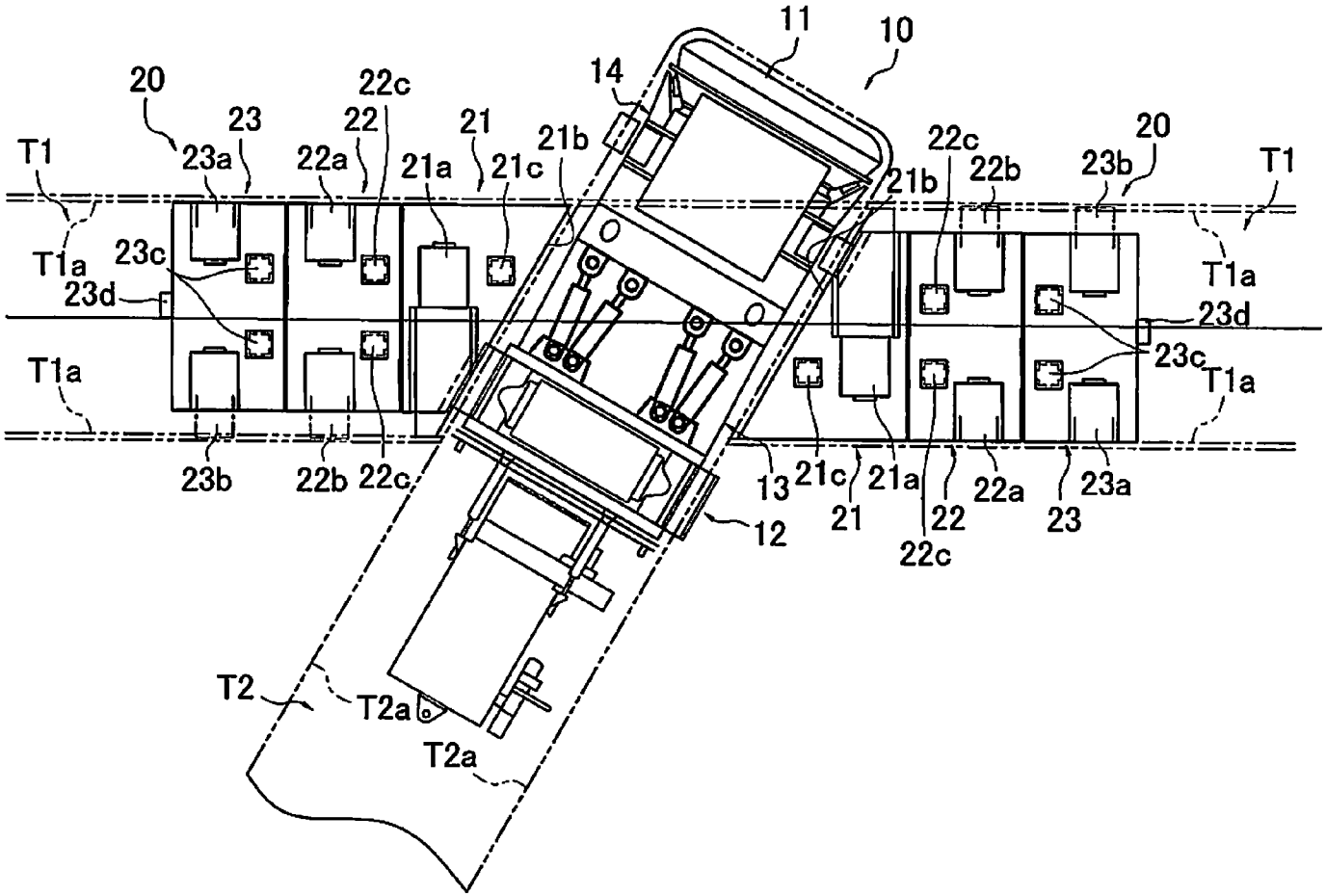
FIG. 2 is a cross section of a state in which tunnel excavation is performed using the boring machine in FIG. 1 and the auxiliary tunneling apparatus of this exemplary embodiment.

In this exemplary embodiment, the boring machine 10 shown in FIG. 1 is used to excavate the first and second tunnels T1 and T2 (see FIG. 2, etc.). The boring machine 10 described in this exemplary embodiment is one with a typical configuration with which excavation is performed by rotating a cutter head while it is supported rearward by a gripper.

The boring machine 10 is used to perform excavation work in a tunnel by moving forward while excavating solid rock or the like. As shown in FIG. 1, the boring machine 10 comprises a cutter head 11, a gripper 12*a*, and a thrust jack 13.

As shown in FIG. 1, the cutter head 11 is disposed on the front end side of the boring machine 10, and excavates rock and the like with a plurality of disk cutters 11*a* provided on the front end surface by rotating around the center axis of the substantially circular tunnel. The cutter head 11 takes bedrock, stones, and so forth that has been finely crushed by the disk cutters 11*a* into its interior through an opening (not shown) formed in the surface.

As shown in FIG. 1, a gripper mounting component 12 is disposed on the rear side of the boring machine 10, and constitutes the rear body of the boring machine 10. The grippers 12*a* are provided on both sides in the width direction of the gripper mounting component 12. As shown in FIG. 2, the grippers 12*a* push against the side wall T2a of the second tunnel T2 being excavated, and this supports the boring machine 10 within the second tunnel T2.

As shown in FIG. 1, the thrust jack 13 is disposed in the middle of the boring machine 10, and constitutes the middle body of the boring machine 10. The thrust jack 13 expands or contracts between the cutter head 11 and the grippers 12*a* to move the boring machine 10 a little at a time through the second tunnel T2 while excavating.

As shown in FIG. 1, a support component 14 is disposed between the cutter head 11 and the thrust jack 13, and constitutes the front body of the boring machine 10 along with the cutter head 11. The support component 14 supports the front body of the boring machine 10 within the second tunnel T2.

Because the boring machine 10 is configured as above, the grippers 12*a* are pressed against the side wall T2a of the second tunnel T2, so that the boring machine 10 is held so that it will not move within the second tunnel T2, and in this state the thrust jack 13 is extended while the cutter head 11 at the front side is rotated, so that the cutter head 11 is pushed snugly in place, and the excavation proceeds through the rock, etc. At this point, with the boring machine 10, the finely crushed rock and so forth is conveyed rearward on a conveyor belt (not shown) or the like. This allows the boring machine 10 to excavate deeper into the second tunnel T2 (see FIG. 2).

That is, with the boring machine 10, the grippers 12*a*, which are disposed further to the rear than the cutter head 11 that performs excavation, push against the side wall T2a of the second tunnel T2 during excavation, and this is a prerequisite to excavate into the second tunnel T2.

Configuration of Auxiliary Tunneling Apparatus 20

As shown in FIG. 2, the auxiliary tunneling apparatus 20 pertaining to this exemplary embodiment is installed on the existing first tunnel T1 side at the intersection between the first and second tunnels T1 and T2 during the excavation of the second tunnel T2, which intersects the first tunnel T1. Two of the auxiliary tunneling apparatuses 20 are installed in the first tunnel T1 to flank the second tunnel T2 from both sides at the intersection of the first and second tunnels T1 and T2.

As the second tunnel T2 is being excavated, the auxiliary tunneling apparatus 20 forms a replacement face that will become a replacement for the side wall T2a, at the portion where there is no side wall T2a, formed at the intersection between the first tunnel T1 and the second tunnel T2 in the excavation of the second tunnel T2.

More precisely, as shown in FIG. 2, the auxiliary tunneling apparatus 20 comprises a reaction force receiver 21 and first and second split components 22 and 23.

Reaction Force Receiver 21

The reaction force receiver 21 is provided on the existing first tunnel T1 side to form a replacement face in the portion where there is no side wall of the second tunnel T2, which occurs at the intersection of the first and second tunnels T1 and T2. As shown in FIG. 2, the reaction force receiver 21 is disposed at the front of the auxiliary tunneling apparatus 20, and has a jack 21*a*, a reaction force receiving face (replacement face) 21*b*, travel wheels (travel components) 21*c*, and a cut component 21*d*.

The jack 21*a* is provided to be able to move back and forth with respect to the side wall T1a of the first tunnel T1 to dispose the reaction force receiving face 21*b* as the replacement face for the side wall T2a at the portion where there is no side wall T2a of the second tunnel T2, which occurs at the intersection of the first and second tunnels T1 and T2. As shown in FIG. 3D, two of these jacks 21*a* are aligned vertically on the side face of the reaction force receiver 21.

Figure 3A:
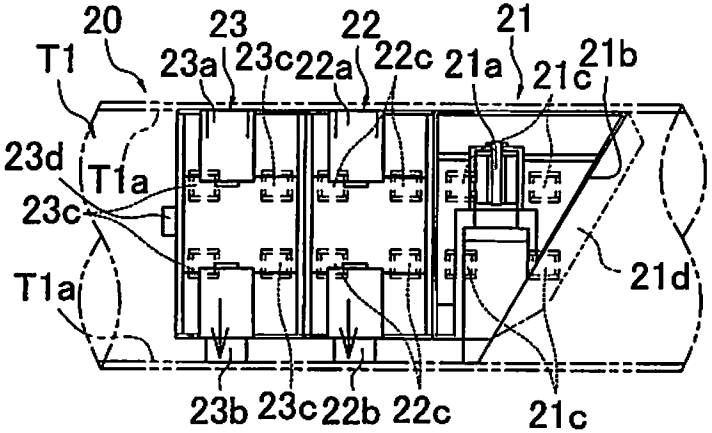
FIG. 3A is a plan view of a state in which the auxiliary tunneling apparatus in FIG. 2 has been installed in a tunnel.
Figure 3D:
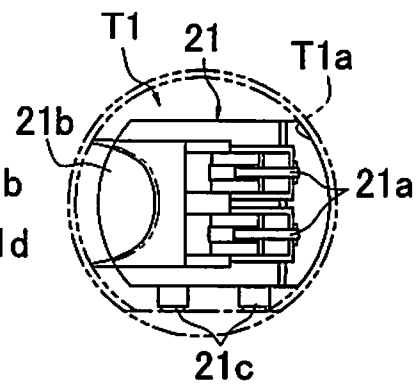
FIG. 3D is a front cross section.
Figure 4A:
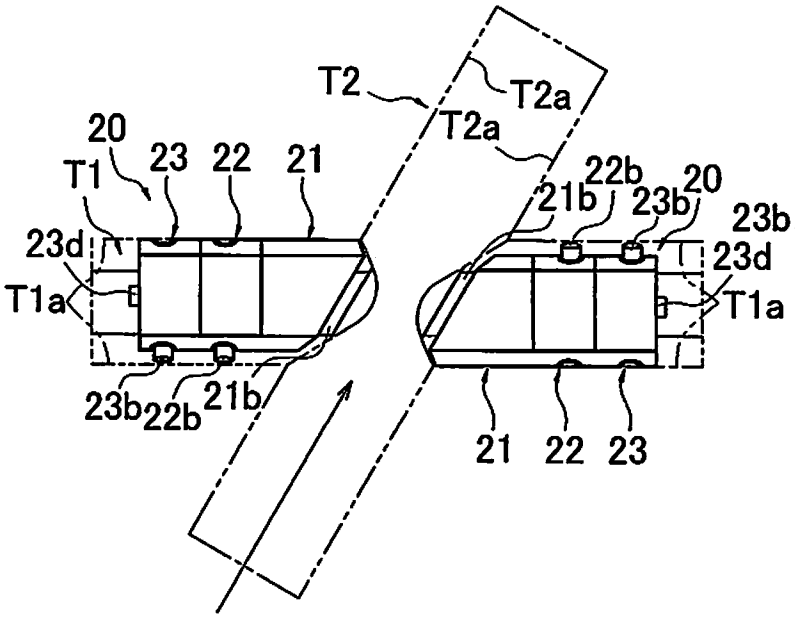

That is, when the auxiliary tunneling apparatus 20 is installed at the intersection of the first and second tunnels T1 and T2, the jacks 21*a* move the reaction force receiving face 21*b* to a specific protrusion position to be part of the side wall T2a of the second tunnel T2 being excavated by the boring machine 10, as shown in FIGS. 3A, 4A, etc.

Figure 5A:
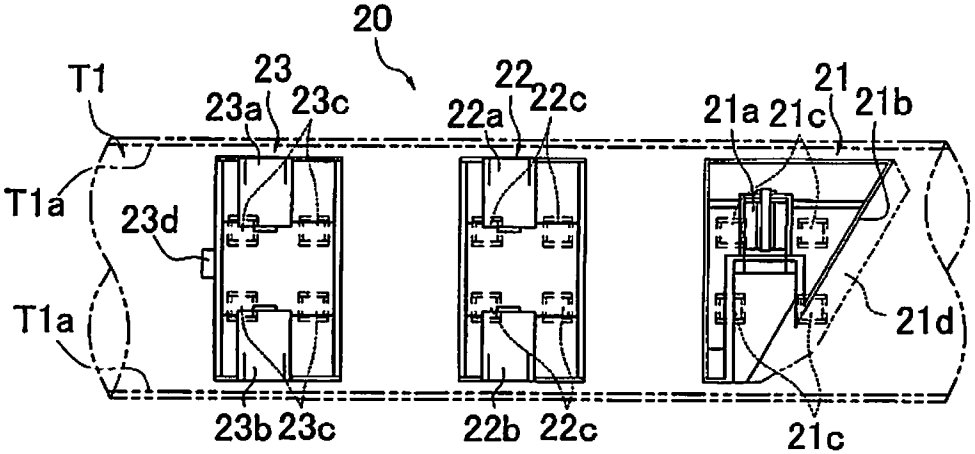
FIG. 5A is a plan view of a state in which the auxiliary tunneling apparatus in FIG. 2 is able to move within the tunnel.
Figure 6B:
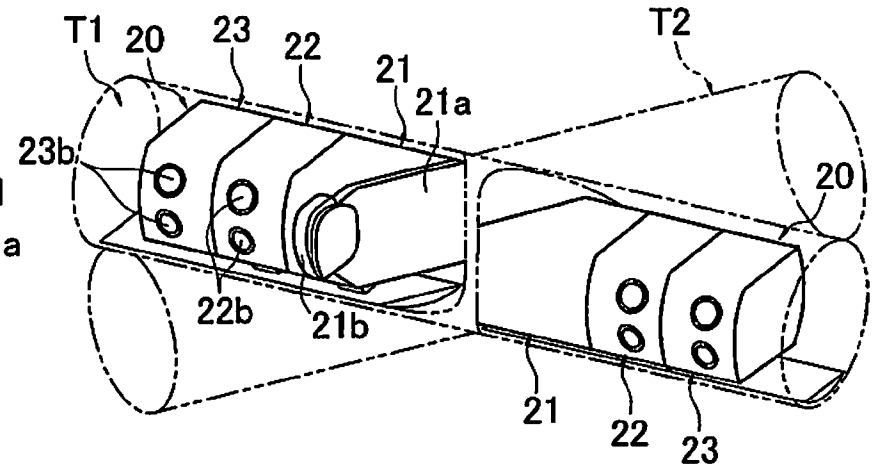
FIGS. 6A and 6B are a plan view and an oblique view of a state in which the auxiliary tunneling apparatus in FIG. 2 is able to move within the tunnel.
Figure 6A:
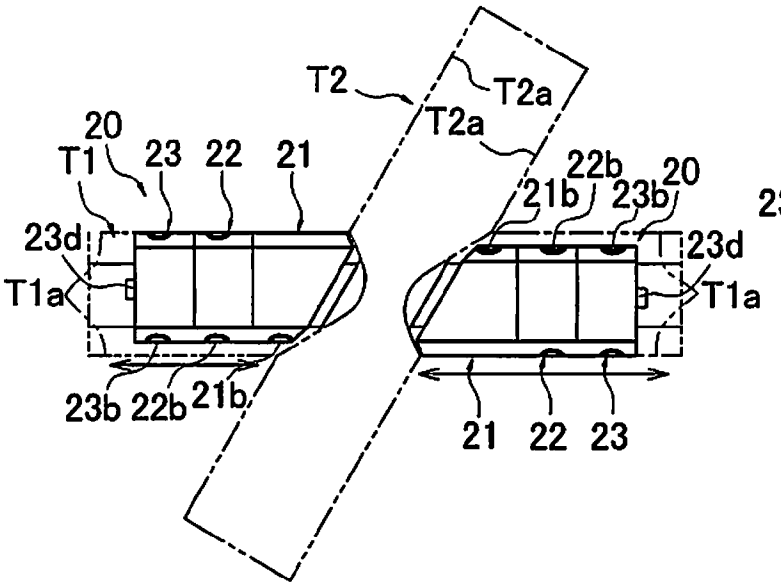

Meanwhile, when the auxiliary tunneling apparatus 20 moves through the first tunnel T1, as shown in FIGS. 5A, 6A, etc., the jacks 21*a* are moved to a specific retraction position to dispose the auxiliary tunneling apparatus 20 at the intersection of the first and second tunnels T1 and T2.

The reaction force receiving face 21*b* is provided to the reaction force receiver 21 in a state in which it can be moved back and forth by the jacks 21*a*, and constitutes part of the side wall T2a of the second tunnel T2 being excavated after moving to the specific protrusion position.

Four of the travel wheels 21*c* are provided to go on the bottom face of the first tunnel T1, as shown in FIG. 3A, to allow the reaction force receiver 21 (the auxiliary tunneling apparatus 20) to travel through the tunnel.

The cut component 21*d* is formed by spraying on concrete or the like to the desired thickness on the surface of the reaction force receiving face 21*b*. The cut component 21*d* is partially cut away by the boring machine 10 during the excavation of the second tunnel T2, which allows a replacement face to be easily formed in substantially the same shape as that of the side wall T2a of the second tunnel T2.

Consequently, there is no need for the shape of the reaction force receiving face 21*b* or the angle of the reaction force receiving face 21*b* to be accurately matched to the shape of the side wall T2a of the second tunnel T2.

First Split Component 22

The first split component 22 is provided to support the auxiliary tunneling apparatus 20 within the first tunnel T1, and is linked to the rear part of the reaction force receiver 21 as shown in FIG. 2. As shown in FIG. 3A, the first split component 22 has a support jack (support component) 22*a*, a support jack (support component) 22*b*, and travel wheels 22*c*. In this exemplary embodiment, the reaction force receiver 21 and the first split component 22 are linked, but the reaction force receiver 21 and the first split component 22 may instead come into contact during tunnel construction, rather than being linked.

The support jack 22*a* is provided in a state of being able to move back and forth with respect to the side wall T1a of the first tunnel T1, within the first tunnel T1 in which the auxiliary tunneling apparatus 20 is installed.

The support jack 22*b* is provided to the side face on the opposite side from the support jack 22*a*, and just as with the support jack 22*a*, is provided in a state of being able to move back and forth with respect to the side wall T1a of the first tunnel T1.

That is, as shown in FIGS. 2, 3A, etc., the support jacks 22*a* and 22*b* move from one of the side faces to the protrusion position during the fixing of the auxiliary tunneling apparatus 20 in the first tunnel T1, which allows the other face of the first split component 22 to push against the side wall Tia of the first tunnel T1. This keeps the first split component 22 in an immobile state within the first tunnel T1.

As shown in FIG. 3A, four of the travel wheels 22*c* are provided to go on the bottom face of the first tunnel T1, so that the first split component 22 (the auxiliary tunneling apparatus 20) can travel through the tunnel.

Second Split Component 23

The second split component 23 is similar to the first split component 22 in that it is provided to support the auxiliary tunneling apparatus 20 within the first tunnel T1, and as shown in FIG. 2, it is linked to the rear part of the first split component 22. As shown in FIG. 3A, the second split component 23 has a support jack (support component) 23*a*, a support jack (support component) 23*b*, travel wheels 23*c*, and a linking component 23*d*.

Figure 3C:
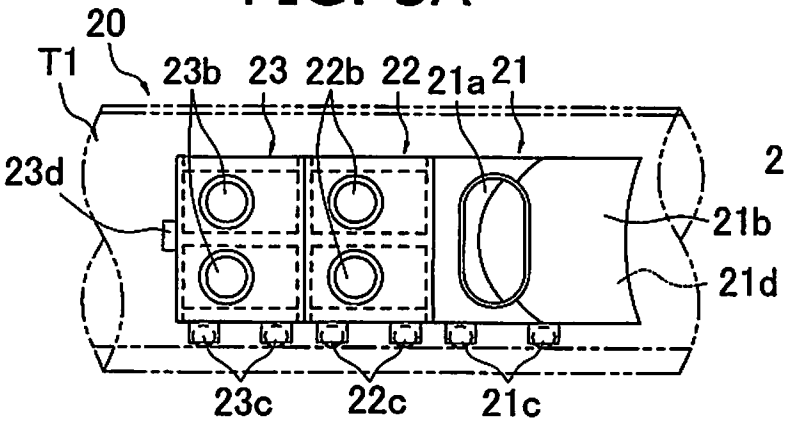
FIG. 3C is a side view thereof.
Figure 3B:
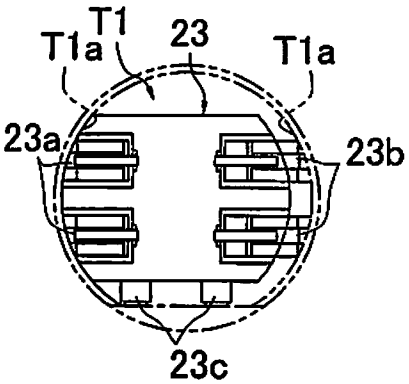
FIG. 3B is a cross section of the rear end side thereof.

The support jack 23*a* is provided in a state of being able to move back and forth with respect to the side wall T1a of the first tunnel T1 within the first tunnel T1 in which the auxiliary tunneling apparatus 20 is installed. As shown in FIG. 3B, two of these support jacks 23*a* are aligned vertically on the side face of the second split component 23.

The support jacks 23*b* are provided on the side face on the opposite side from the support jacks 23*a*, and just as with the support jacks 23*a*, are provided in a state of being able to move back and forth with respect to the side wall T1a of the first tunnel T1. Also, just as with the support jacks 23*a*, two of the support jacks 23*b* are aligned vertically on the side face of the second split component 23 on the opposite side from the support jacks 23*a*, as shown in FIGS. 3B and 3C.

That is, as shown in FIGS. 2, 3A, etc., the support jacks 23*a* and 23*b* move from one of the side faces to the protrusion position during the fixing of the auxiliary tunneling apparatus 20 within the first tunnel T1, which pushes the other face of the second split component 23 against the side wall T1a of the first tunnel T1. Consequently, the second split component 23 is kept in an immobile state within the first tunnel T1.

Four of the travel wheels 23*c* are provided to go on the bottom face of the first tunnel T1, as shown in FIG. 3A, to allow the second split component 23 (the auxiliary tunneling apparatus 20) to travel through the tunnel.

The linking component 23*d* is provided to the rear end face of the second split component 23, and links the auxiliary tunneling apparatus 20 to a tow vehicle (not shown).

Fixed State of Auxiliary Tunneling Apparatus 20

As discussed above, the auxiliary tunneling apparatus 20 in this exemplary embodiment is disposed on the first tunnel T1 side to provide a replacement face for the side wall of the second tunnel T2 during the excavation of the second tunnel T2, which intersects the existing first tunnel T1.

When the second tunnel T2 is being excavated by the boring machine 10, the excavation proceeds while the grippers 12*a* push against the side wall T2a of the second tunnel T2, so the replacement face for the side wall T2a installed by the auxiliary tunneling apparatus 20 is subjected to high pressure from the grippers 12*a*. Thus, the auxiliary tunneling apparatus 20 needs to withstand the pressure of the grippers 12*a* within the existing first tunnel T1.

In view of this, with the auxiliary tunneling apparatus 20 in this exemplary embodiment, when pressure is exerted by the grippers 12*a* of the boring machine 10, the support jacks 22*b* and 23*b* protrude from one side face of the first and second split components 22 and 23 as shown in FIGS. 3A to 4B so that the device will not move within the first tunnel T1.

In this exemplary embodiment, the first and second split components 22 and 23 are fixed with respect to the tunnel side wall by extending one support jack in the width direction of the first and second split components 22 and 23, but both support jacks in the width direction may instead be extended for this fixing.

Consequently, as shown in FIG. 4A, the first and second split components 22 and 23 push on one side against the side wall T1a of the first tunnel T1. Therefore, even when pressure is exerted on the reaction force receiving face 21*b* of the reaction force receiver 21 from the grippers 12*a* of the boring machine 10 during excavation of the second tunnel T2, the entire auxiliary tunneling apparatus 20 can be held still so that it does not move within the first tunnel T1.

Movable State of Auxiliary Tunneling Apparatus 20

Figure 5C:
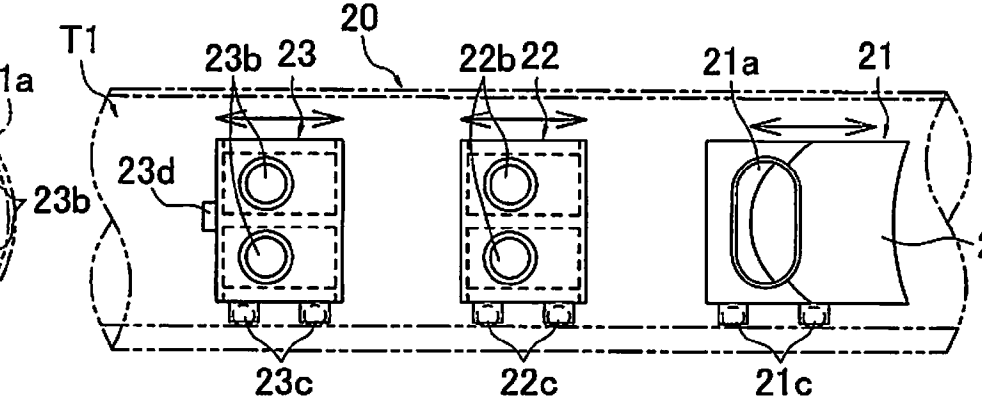
FIG. 5C is a side view thereof.
Figure 5D:
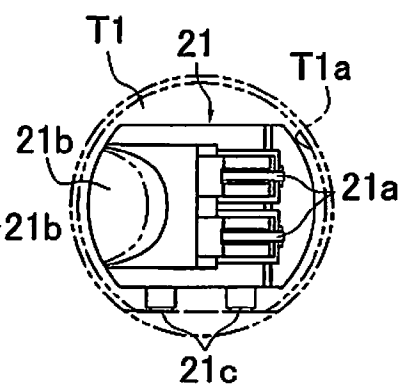
FIG. 5D is a front cross section thereof.
Figure 5B:
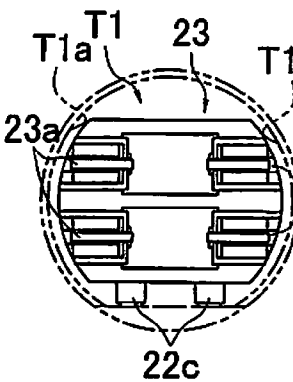
FIG. 5B is a cross section of the rear end side thereof.

Meanwhile, when the auxiliary tunneling apparatus 20 performs excavation work in which there are a plurality of intersections of the first and second tunnels T1 and T2, for example, the support jacks 22*b* and 23*b* protruding from one side face of the first and second split components 22 and 23 are moved to their retracted position as shown in FIGS. 5 and 6 during the installation of the replacement face for the side wall T2a of the second tunnel T2 at each intersection.

As shown in FIG. 5C, etc., the auxiliary tunneling apparatus 20 here has the travel wheels 21*c*, 22*c*, and 23*c* on the bottom faces of the reaction force receiver 21 and the first and second split components 22 and 23.

Consequently, the linking component 23*d* of the second split component 23 can be linked to a tow vehicle (not shown), allowing the auxiliary tunneling apparatus 20 to be smoothly towed by the tow vehicle and relocated within the first and second tunnels T1 and T2.

In this exemplary embodiment, the device is moved through the tunnel by the rolling of the travel wheels 21*c*, 22*c*, and 23*c* on the bottom faces, but skids may instead be provided to the device bottom face, and the device moved by sliding.

Furthermore, curve portions and so forth need to be negotiated to move the auxiliary tunneling apparatus 20 smoothly up to the next intersection of the first and second tunnels T1 and T2.

In view of this, as shown in FIG. 5C, with the auxiliary tunneling apparatus 20 in this exemplary embodiment the reaction force receiver 21 and the first and second split components 22 and 23 can be split apart and moved. Also, because the auxiliary tunneling apparatus 20 employs a structure in which it is split into a plurality of blocks (the reaction force receiver 21 and the first and second split components 22 and 23), an effect can be obtained whereby it is easier to negotiate curves and so forth.

Effect of Auxiliary Tunneling Apparatus 20

As shown in FIG. 2, the auxiliary tunneling apparatus 20 of this exemplary embodiment is installed on the first tunnel T1 side in the excavation of the second tunnel T2 that intersects the existing first tunnel T1, by using the boring machine 10 to perform excavation in a state in which the grippers 12*a* push against the side wall T2a. The auxiliary tunneling apparatus 20 comprises the reaction force receiver 21, which includes the reaction force receiving face 21*b* that serves as a replacement face at the intersection between the first and second tunnels T1 and T2 where there is no side wall T2a of the second tunnel T2, and the first and second split components 22 and 23, which include the support jacks 22*a* and 22*b* and the support jacks 23*a* and 23*b* for supporting the reaction force receiver 21 so that it does not move through the first tunnel T1.

Consequently, the reaction force receiving face 21*b* that serves as a replacement face for the side wall T2a of the second tunnel T2 can be installed at the intersection between the first and second tunnels T1 and T2. Thus, the excavation work using the boring machine 10 at the intersection of the mutually intersecting first and second tunnels T1 and T2 can be carried out more smoothly than in the past. As a result, even when excavating the mutually intersecting first and second tunnels T1 and T2, the time it takes to carry out the tunnel excavation work will be shorter than in the past.

The auxiliary tunneling apparatus 20 in this exemplary embodiment has all of the travel wheels 21*c*, 22*c*, and 23*c* provided to the reaction force receiver 21 and the first and second split components 22 and 23 constituting the auxiliary tunneling apparatus 20. Accordingly, the auxiliary tunneling apparatus 20 can be towed by a tow vehicle (not shown), allowing it to be moved freely through the first and second tunnels T1 and T2.

As discussed above, the auxiliary tunneling apparatus 20 in this exemplary embodiment is configured so that the reaction force receiver 21 and the first and second split components 22 and 23 are split into three.

Consequently, this split structure can be used to allow the auxiliary tunneling apparatus 20 to negotiate curves in the tunnel, including the first and second tunnels T1 and T2.

Also, because the apparatus can be longer while still being able to negotiate curves, the planar pressure of the support components on the tunnel side walls can be reduced. Furthermore, because the reaction force receiver 21 and the first and second split components 22 and 23 can be split, tunnels with different intersection angles can be constructed by changing just the reaction force receiver 21.

The auxiliary tunneling apparatus 20 in this exemplary embodiment comprises the cut component 21*d*, which is formed by spraying on concrete or the like to at least a specific thickness at the portion of the reaction force receiver 21 facing the second tunnel T2.

Consequently, when the second tunnel T2 is being excavated by the boring machine 10, part of the reaction force receiving face 21*b* will be cut away by the cutter head 11 at the distal end of the boring machine 10, in a shape that is substantially the same as the shape of the side wall T2a of the second tunnel T2. Thus, when the boring machine 10 subsequently moves forward, the grippers 12*a* can be brought into contact with the reaction force receiving face 21*b* in the same state as with the side wall T2a of the second tunnel T2. Thus, there is no need to worry about accurately adjusting the angle of the reaction force receiving face 21*b* or forming the shape of the reaction force receiving face 21*b* to match the shape of the side wall T2a of the second tunnel T2.

Tunnel Excavation Method

The tunnel excavation method pertaining to this exemplary embodiment will now be described through reference to FIGS. 7A to 10B.

In this exemplary embodiment, the tunnel is excavated according to the following procedure, using the above-mentioned boring machine 10 and auxiliary tunneling apparatus 20.

Figure 7B:
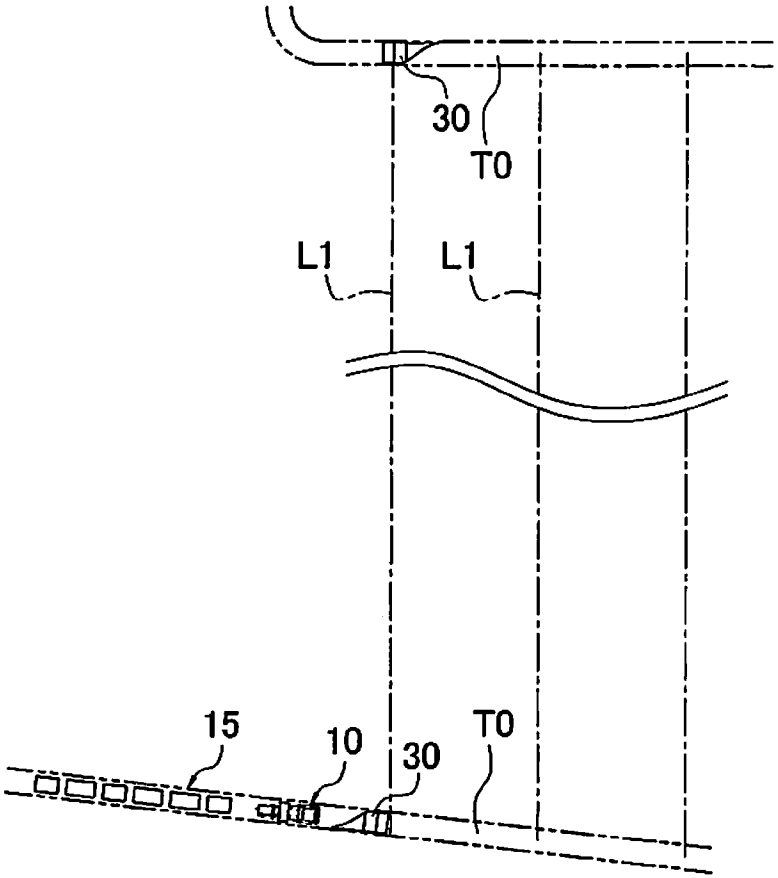
FIGS. 7A and 7B show the procedure for tunnel excavation by the tunnel excavation method pertaining to an exemplary embodiment of the present invention.
Figure 7A:
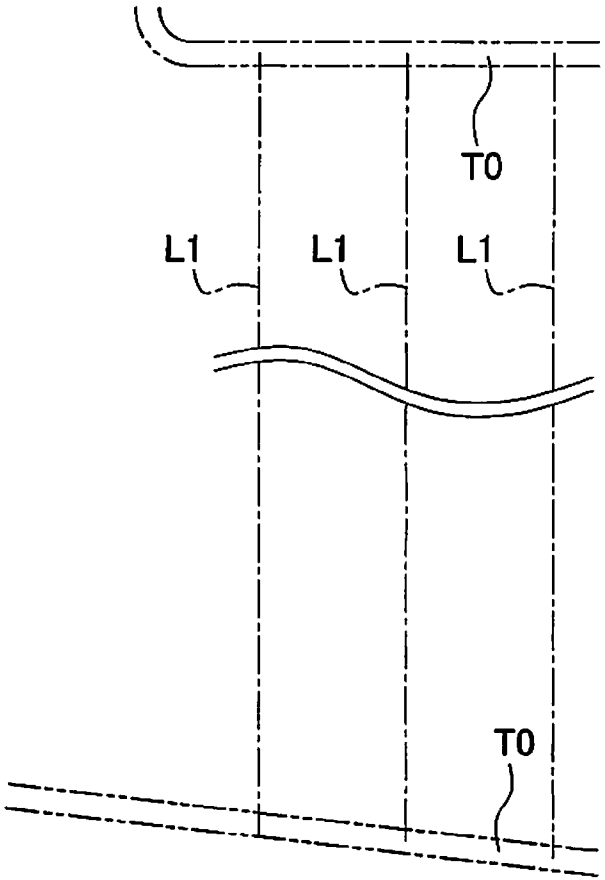

First, as shown in FIG. 7A, in step S1, a first excavation line L1 is set to excavate three first tunnels T1 that are substantially parallel to each other, from an existing two tunnels T0.

Then, as shown in FIG. 7B in step S2, the boring machine 10 follows a backup trailer 15 to the rear, and the boring machine 10 is moved by a tow vehicle to a position where an existing tunnel T0 branches off to a first tunnel T1.

At this point, a corner-use reaction force receiver 30 is installed at the portion where the existing tunnel T0 branches off to the first tunnel T1. Consequently, the boring machine 10 is able to keep excavating the first tunnel T1 while the grippers 12*a* are kept in contact with the reaction force receiver 30, even at the bent portions that branch off to the first tunnel T1.

Here, the reaction force receiving face of the corner-use reaction force receiver 30 preferably has the same shape as the side wall T1a of the first tunnel T1. Alternatively, the cut component 21*d* may be provided to the surface, as with the reaction force receiving face 21*b* of the auxiliary tunneling apparatus 20 discussed above, and given a shape that will better conform to the grippers 12*a* while the boring machine 10 is excavating.

Figure 8B:
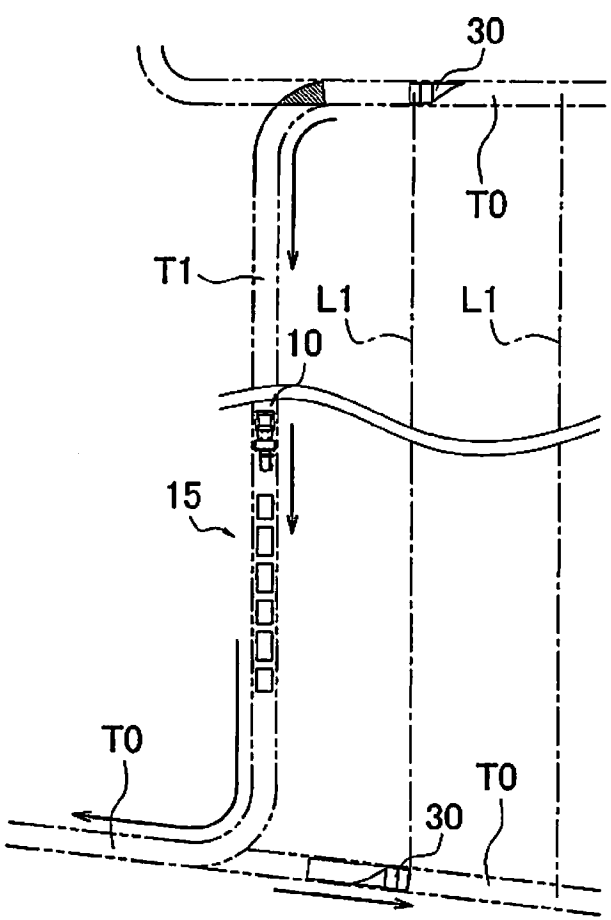
FIGS. 8A and 8B show the procedure for tunnel excavation by the tunnel excavation method pertaining to an exemplary embodiment of the present invention.
Figure 8A:
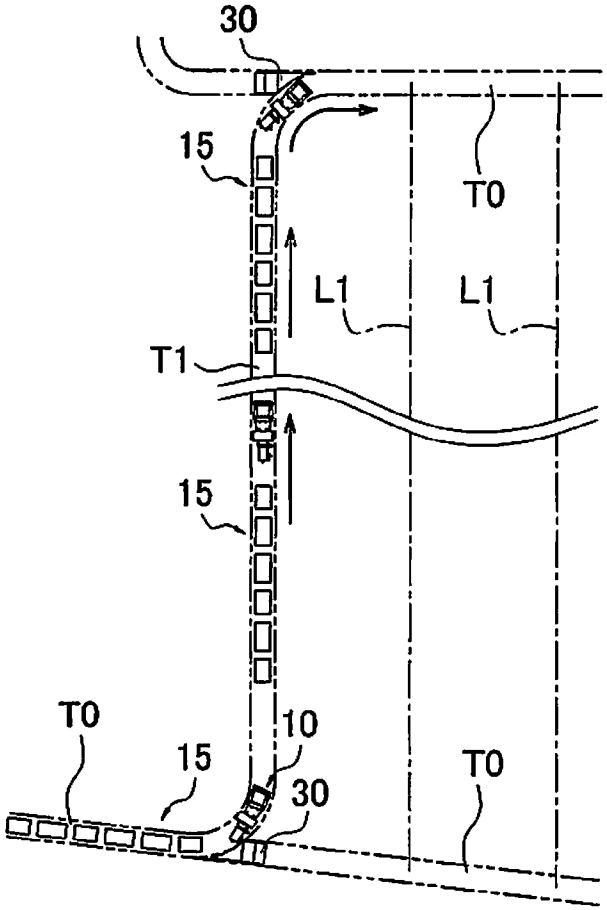

Then, as shown in FIG. 8A, in step S3, the boring machine 10 is moved while excavating solid rock, etc., along the first excavation line L1. This allows the first tunnel T1 to be formed in the desired location. The backup trailer 15 may also be moved along with the boring machine 10 here.

Then, as shown in FIG. 8B, in step S4, once the excavation up to the existing tunnel T0 formed at an isolated position is complete, and the first tunnel T1 passes through the tunnel T0, the boring machine 10 is returned by the tow vehicle to the initial positions shown in FIG. 7B.

As shown in FIG. 8A, just as in step S2, the corner-use reaction force receiver 30 is installed at the portion where the first tunnel T1 reaches the tunnel T0.

Figure 9B:
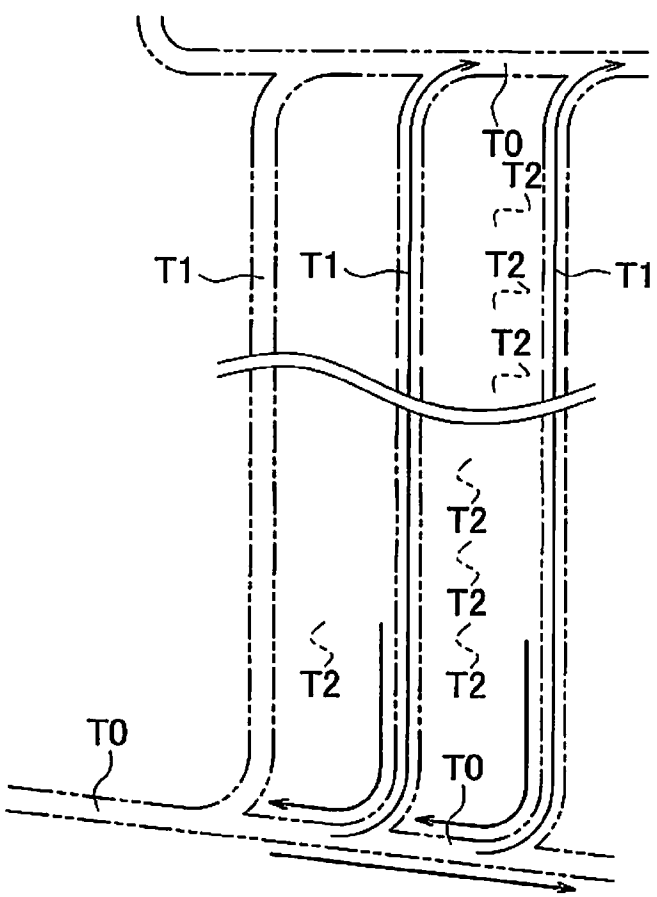
FIGS. 9A and 9B show the procedure for tunnel excavation by the tunnel excavation method pertaining to an exemplary embodiment of the present invention.
Figure 9A:
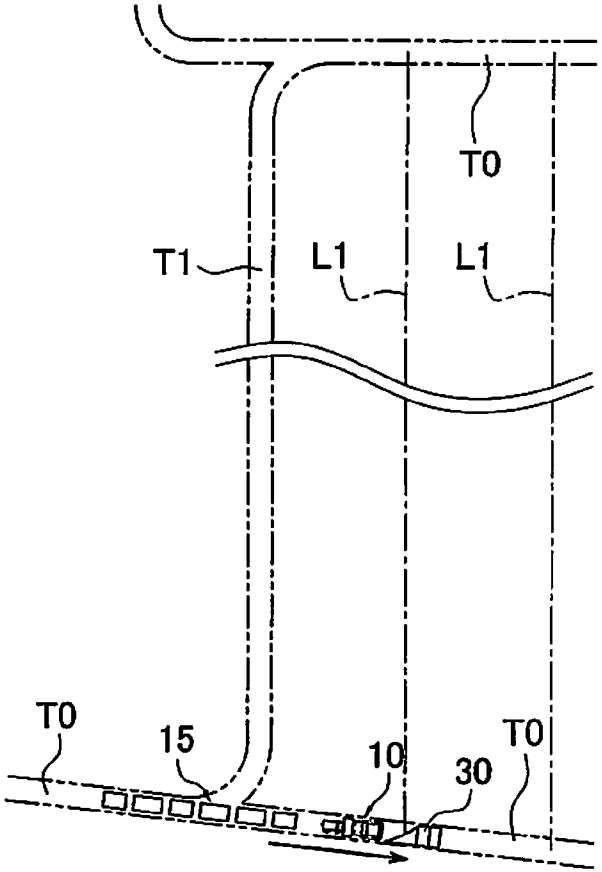

Then, as shown in FIG. 9A, in step S5 (first excavation step), the boring machine 10 is again moved along the first excavation line L1 to excavate a new first tunnel T1 that is substantially parallel to the excavated first tunnel T1.

Then, as shown in FIG. 9B, in step S6 (first excavation step), the above-mentioned steps S3 to S5 are repeated to excavate three first tunnels T1 that are substantially parallel to each other, after which a second excavation line L2 is set to form a plurality of second tunnels T2 that intersect these three first tunnels T1. The places where the first tunnels T1 intersect the second excavation line L2, that is, the places where the first tunnels T1 and the second tunnels T2 intersect, are termed planned intersection portions.

Figure 10B:
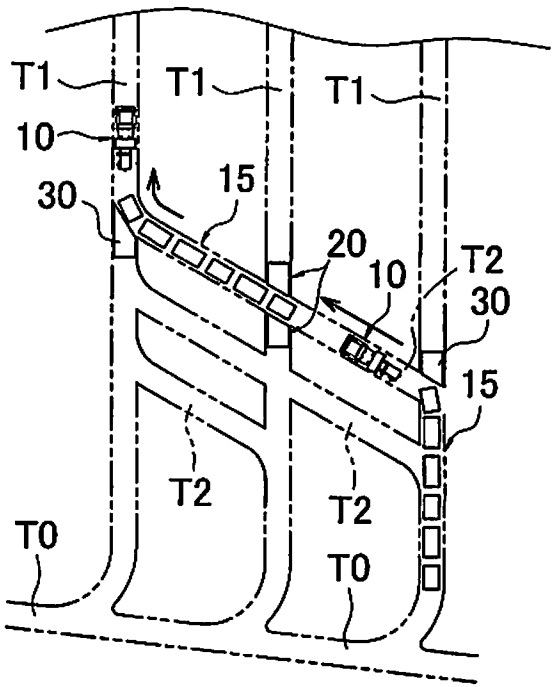
FIGS. 10A and 10B show the procedure for tunnel excavation by the tunnel excavation method pertaining to an exemplary embodiment of the present invention.
Figure 10A:
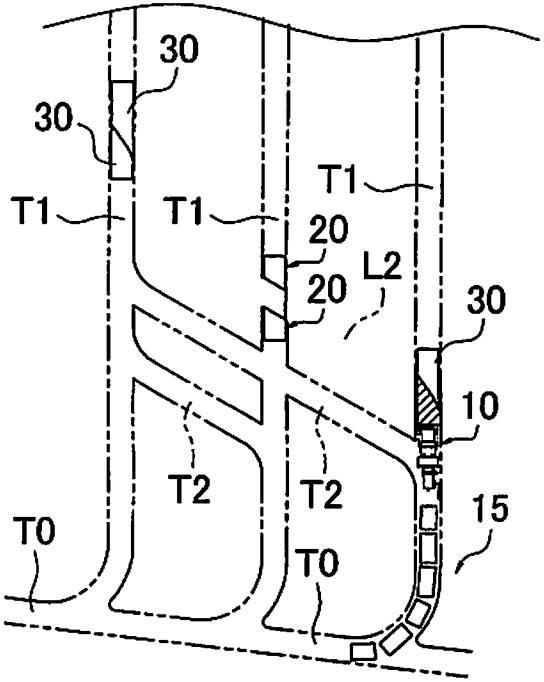

Then, as shown in FIG. 10A, in step S7 (second excavation step), the boring machine 10 is moved while excavating solid rock, etc., along the first second excavation line L2. This allows the second tunnel T2, which intersects the existing first tunnel T1, to be formed in the desired location.

At this point, as shown in FIG. 10A, two of the above-mentioned auxiliary tunneling apparatuses 20 that have been prepared in advance moved through the first tunnel T1 and relocated, and are installed on the first tunnel T1 side at the portion where the existing first tunnel T1 and the second excavation line L2 intersect, flanking the above-mentioned intersection. Also, the above-mentioned corner-use reaction force receivers 30 are installed at each of the portions where the first tunnel T1 branches off to the second tunnel T2, and where they come together.

Then, as shown in FIG. 10B, in step S8 the boring machine 10 moves along the second excavation line L2, passing through the intersection of the first and second tunnels T1 and T2, and excavating up to the merge with the existing first tunnel T1.

After the boring machine 10 has passed the intersection at which the auxiliary tunneling apparatus 20 is installed, the auxiliary tunneling apparatus 20 is towed by a tow vehicle or the like, and is then moved to the intersection between the first and second tunnels T1 and T2 through which the boring machine 10 passes (movement step).

The boring machine that has been moved to the first tunnel T1 is moved via a tunnel loop (not shown), and the above steps are repeated to excavate a plurality of parallel second tunnels one after the other.

Effects of this Tunnel Excavation Method

As shown in FIGS. 7A to 10B, the tunnel excavation method in this exemplary embodiment comprises a step of excavating three tunnels T1 that are substantially parallel to each other (first excavation step), and a step of excavating second tunnels T2 that intersect the first tunnels T1 (second excavation step), using the boring machine 10, which performs excavation in a state in which the grippers 12*a* push against the side walls of the tunnel.

Consequently, in tunnel excavation that includes portions where a plurality of tunnels branch and merge, the boring machine 10 need only move in a substantially straight line, so the tunnel excavation work takes less time than in the past.

With the tunnel excavation method in this exemplary embodiment, in the step of excavating the second tunnel T2 that intersects the existing first tunnel T1, the auxiliary tunneling apparatus 20, which comprises the reaction force receiver 21 that forms a replacement face for the side wall T2a of the second tunnel T2, is disposed at the portion where the first and second tunnels T1 and T2 intersect.

Consequently, the reaction force receiving face 21*b* that becomes the replacement face can be provided at the portion of the second tunnel T2 where there is no side wall T2a, which occurs at the intersection of the first and second tunnels T1 and T2. Thus, in tunnel excavation that includes a plurality of tunnel intersections, the work can be performed more efficiently than in the past, and the work will take less time.

With the tunnel excavation method in this exemplary embodiment, in tunnel excavation in which a plurality of intersections between the first and second tunnels T1 and T2 are formed, once the boring machine 10 passes an intersection where the auxiliary tunneling apparatus 20 is installed, the auxiliary tunneling apparatus 20 is then moved to the intersection passed by the boring machine 10.

Consequently, even when there are a plurality of intersections of the first and second tunnels T1 and T2, excavation by the boring machine 10 can still be carried out smoothly. This allows the tunnel excavation work to be carried out in less time than in the past.

With the tunnel excavation method in this exemplary embodiment, the corner-use reaction force receiver 30 is provided at the branching and merging portions from the tunnel T0 to the first tunnel T1, or at the branching and merging portions from the first tunnel T1 to the second tunnel T2.

Consequently, the boring machine 10 can move and excavate even at the branching and merging portions of the tunnels. This allows the tunnel excavation work to be carried out in less time than in the past.

Other Exemplary Embodiments

An exemplary embodiment of the present invention was described above, but the present invention is not limited to or by the above exemplary embodiment, and various modifications are possible without departing from the gist of the present invention.

In the above exemplary embodiment, an example was described in which the cut component 21*d* composed of concrete or the like was provided to the reaction force receiving face 21*b* of the reaction force receiver 21 of the auxiliary tunneling apparatus 20, and the boring machine 10 excavated this cut component 21*d* while excavating the tunnel T2. The present invention is not limited to this, however.

Figure 11:
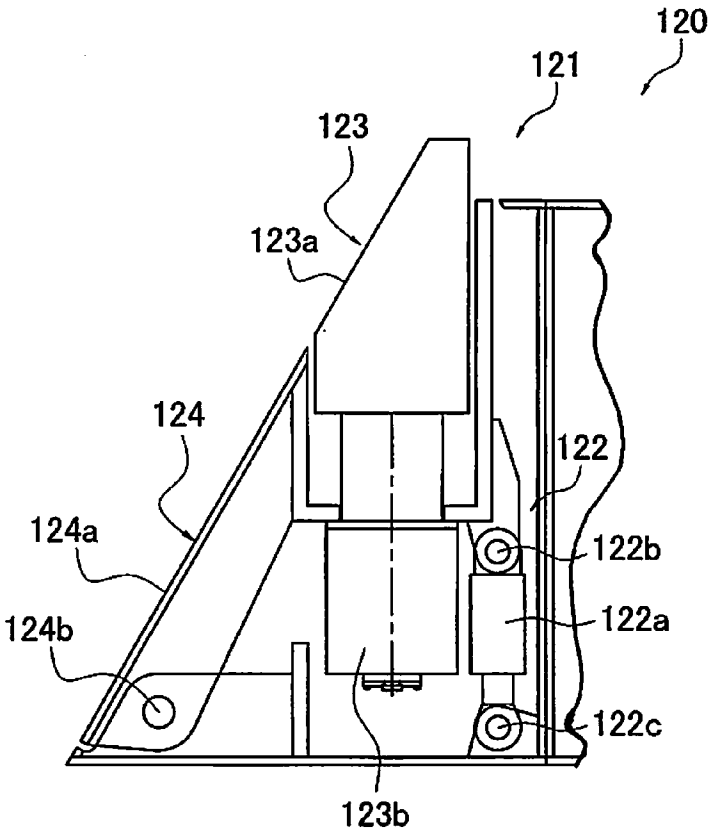
FIG. 11 is a cross section of the internal configuration of the auxiliary tunneling apparatus pertaining to another exemplary embodiment of the present invention.

For example, as shown in FIG. 11, an auxiliary tunneling apparatus 120 may comprise a reaction force receiver 121 equipped with an angle adjustment mechanism 122 that adjusts the angle of the reaction force receiving face formed to match the shape of the side wall of the tunnel T2 being excavated.

More specifically, as shown in FIG. 11, the auxiliary tunneling apparatus 120 comprises the reaction force receiver 121 that has the angle adjustment mechanism 122, a first receiver 123, and a second receiver 124. Just as in the first exemplary embodiment, the first and second split components 22 and 23 are linked on the opposite side of the reaction force receiver 121 from the excavation side.

As shown in FIG. 11, the angle adjustment mechanism 122 has a jack 122*a*, a rotation shaft 122*b*, and a rotation shaft 122*c*.

The jack 122*a* expands and contracts to adjust the angle of reaction force receiving faces 123*a* and 124*a* that serve as replacement faces for the side wall T2a of the second tunnel T2.

The rotation shafts 122*b* and 122*c* are provided at the two ends of the jack 122*a*, and when the jack 122*a* expands or contracts, the first and second receivers 123 and 124 are rotated to adjust the angle of the reaction force receiving faces 123*a* and 124*a* that serve as replacement faces for the side wall T2a of the second tunnel T2.

The first receiver 123 has the force receiving face (replacement face) 123*a* and a jack 123*b*.

The reaction force receiving face 123*a* constitutes part of the replacement face for the side wall T2a of the second tunnel T2.

The jack 123*b* is provided to be able to move back and forth with respect to the side wall T1a of the first tunnel T1 to dispose the reaction force receiving face 123*a* as the replacement face for the side wall T2a at the portion where there is no side wall T2a of the second tunnel T2, which occurs at the intersection between the first and second tunnels T1 and T2.

When the auxiliary tunneling apparatus 120 is moved through the tunnel, the reaction force receiving face 123*a* can be moved to its retracted position by retracting the jack 123*b*.

The second receiver 124 has a reaction force receiving face (replacement face) 124*a* and a rotation shaft 124*b*.

The reaction force receiving face 124*a* constitutes the replacement face for the side wall T2a of the second tunnel T2 along with the reaction force receiving face 123*a* of the first receiver 123.

The rotation shaft 124*b* serves as the rotational center around which the reaction force receiving face 124*a* is rotated when the jack 122*a* of the angle adjustment mechanism 122 is expanded and contracted.

Figure 12B:
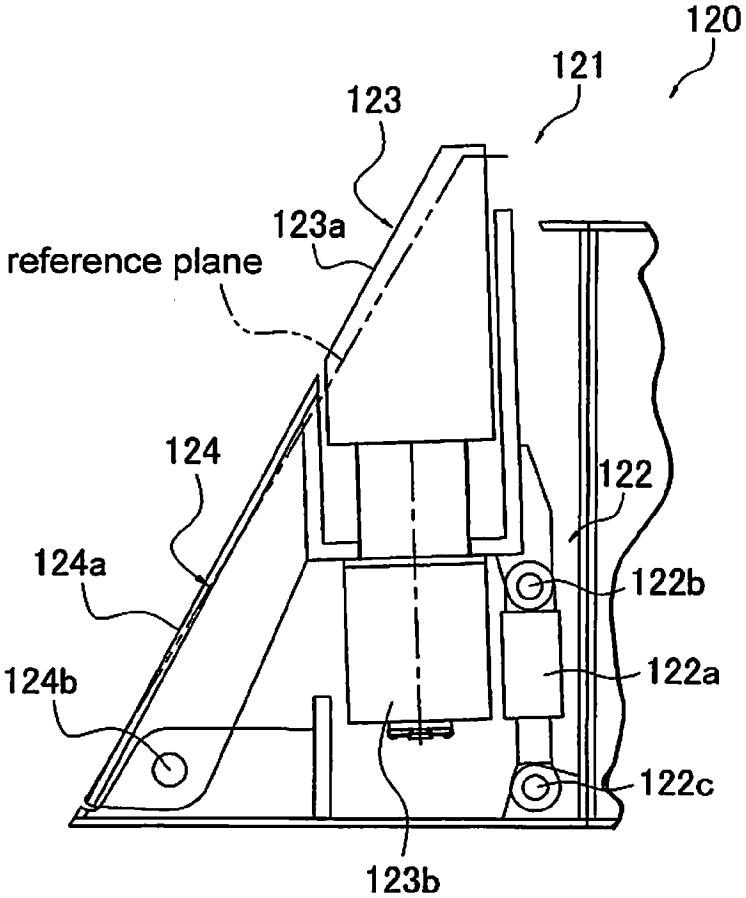
FIGS. 12A and 12B are diagrams illustrating a mechanism for adjusting the angle of the reaction force receiver of the auxiliary tunneling apparatus in FIG. 11.
Figure 12A:
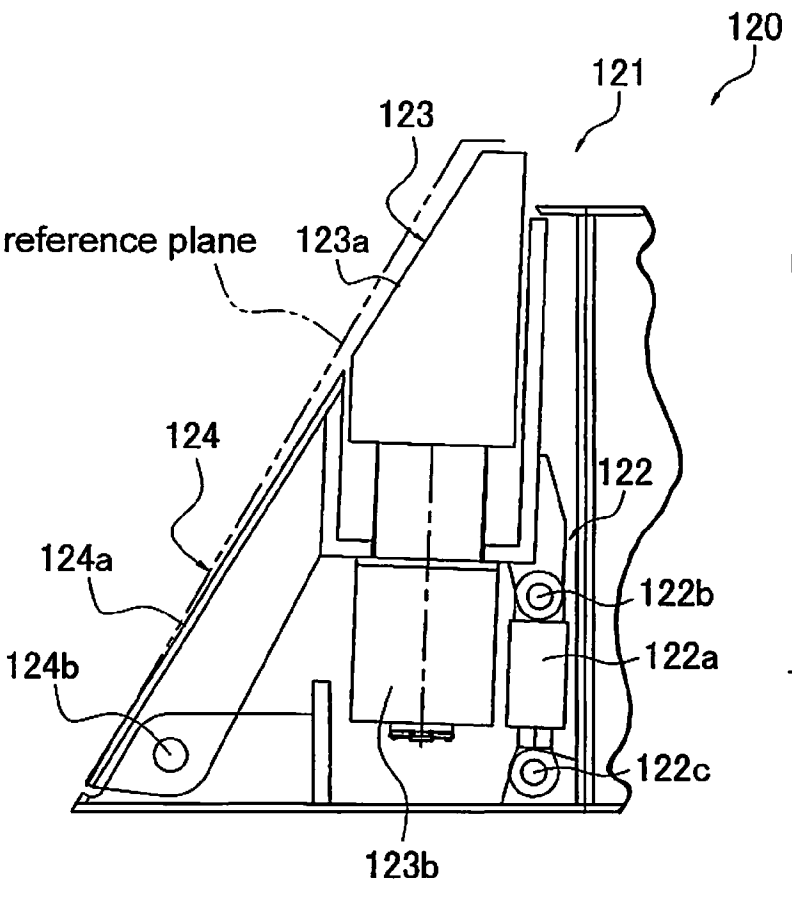

With the auxiliary tunneling apparatus 120 in this exemplary embodiment, as shown in FIG. 12*a*, because of the above configuration, the jack 122*a* of the angle adjustment mechanism 122 can be retracted from its initial position to adjust the angle of the reaction force receiving faces 123*a* and 124*a* of the first and second reaction force receiving faces 123 and 124 to a position that is retracted with respect to the reference plane.

As shown in FIG. 12B, meanwhile, the jack 122*a* of the angle adjustment mechanism 122 can be expanded from its initial position to adjust the angle of the reaction force receiving faces 123*a* and 124*a* of the first and second reaction force receiving faces 123 and 124 to a position that protrudes with respect to the reference plane.

Consequently, even when no cut component has been formed by spraying on concrete or the like on the surface of the reaction force receiving faces 123*a* and 124*a*, the angle of the reaction force receiving faces 123*a* and 124*a* can be properly adjusted to match the shape of the side wall T2a of the second tunnel T2.

In the above exemplary embodiment, an example was given in which the linking component 23*d* was provided to the second split component 23 of the auxiliary tunneling apparatus 20, and the linking component 23*d* was linked to a tow vehicle, which allows the auxiliary tunneling apparatus 20 to move through the tunnel, but the present invention is not limited to this.

Figure 13:
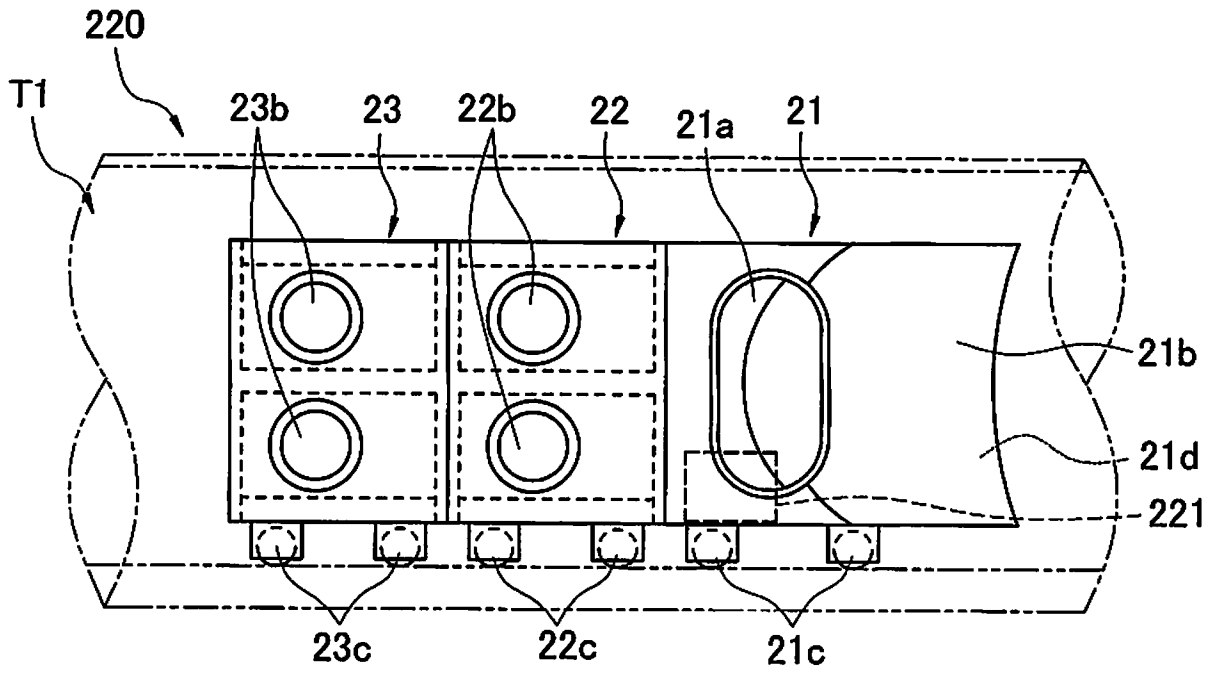
FIG. 13 is a side view of the configuration of the auxiliary tunneling apparatus pertaining to yet another exemplary embodiment of the present invention.

For example, as shown in FIG. 13, a self-propelled auxiliary tunneling apparatus 220 may have an engine 221 installed in the reaction force receiver 21, so that a rotary drive force is exerted on the travel wheels 21*c*.

Here again, because the auxiliary tunneling apparatus 220 can be moved smoothly, the excavation work in tunnel excavation that includes portions where a plurality of tunnels intersect can be carried out in less time than in the past.

The location where the engine 221 is installed is not limited to the reaction force receiver 21, and may instead be the first and second split components 22 and 23.

The drive source for rotationally driving the travel wheels is not limited to an engine, and may instead be a motor that is driven by a battery, etc.

In the above exemplary embodiment, an example was given of a tunnel excavation method in which second tunnels T2 that intersect three first tunnels T1 are excavated, but the present invention is not limited to this.

For example, the number of existing first tunnels T1 that are excavated prior to the excavation of the second tunnels T2 may be four or more.

Here again, as discussed above, the first and second tunnels T1 and T2 including mutually intersecting portions can be excavated efficiently, so the job will take less time than in the past.

In the above exemplary embodiment, an example was given in which the auxiliary tunneling apparatus 20 had a structure in which the reaction force receiver 21 and the first and second split components 22 and 23 were split in three, but the present invention is not limited to this.

For example, the auxiliary tunneling apparatus may be configured as a unit.

Also, when a split structure is employed, the structure may be one that is split in two, or in four or more parts.

In the above exemplary embodiment, after one first tunnel T1 was excavated, the boring machine 10 was retracted through that one first tunnel T1, and then excavated a first tunnel T1 that was parallel to that one first tunnel T1. Also, after the excavation of one second tunnel T2, the boring machine 10 moves through a tunnel loop that is contiguous with the first tunnel T1 that intersects this one second tunnel T2, after which it excavates a second tunnel T2 that is parallel to the one second tunnel T2. In other words, an example was given in which the boring machine 10 was facing in the same direction when it excavated the first tunnel T1 and the second tunnel T2. However, the present invention is not limited to this.

Figure 14:
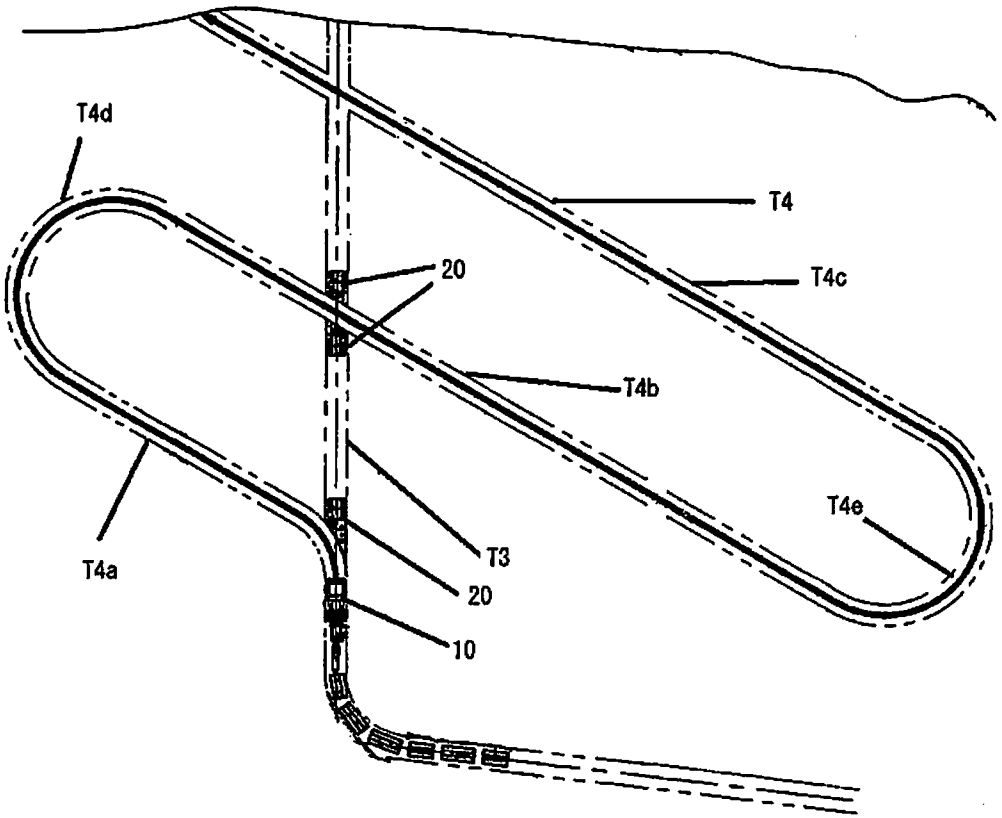
FIG. 14 is a diagram illustrating the tunnel excavation method pertaining to another exemplary embodiment of the present invention.

For example, as shown in FIG. 14, a second tunnel T4 that intersects a first tunnel T3 may be formed from sections T4a, T4b, and T4c that are parallel, and curved sections T4d and T4e that link up with these straight sections. The boring machine 10 may then be kept moving constantly forward to excavate the second tunnel T4. In the excavation of adjacent, parallel sections (such as T4a and T4b), the boring machine 10 will advance in opposite directions. The same configuration is possible for the first tunnel T3.

In this exemplary embodiment, the boring machine 10 is not retracted or diverted, so the job can be performed more efficiently.

The tunnel excavation method of exemplary embodiments of the present invention has the effect of allowing efficient excavation at merging portions of a tunnel, and particularly at intersections, and therefore can be widely applied to excavation methods for tunnels that include intersections.

The invention claimed is:

1. A tunnel excavation method in which a tunnel is excavated using a boring machine that performs excavation by rotating a cutter head while a gripper of the boring machine pushes against a side wall of the tunnel, the method comprising:

a first excavation step of excavating at least three first tunnels that are substantially parallel to each other; and a second excavation step of excavating a second tunnel that intersects and crosses through one of the first tunnels at a first intersection, the second excavation step including disposing first auxiliary tunneling apparatus within the first tunnel at a position corresponding to the first intersection of the first and second tunnels, the first auxiliary tunneling apparatus being equipped with a reaction force receiver that forms a replacement face that substitutes as a part of a side wall of the second tunnel while the boring machine crosses through the first intersection.

2. The tunnel excavation method according to claim 1, further comprising moving the first auxiliary tunneling apparatus to another intersection of the first and second tunnels after excavation of the first intersection of the first and second tunnels in the second excavation step.

3. The tunnel excavation method according to claim 2, wherein in the first excavation step, a second auxiliary tunneling apparatus is disposed that comprises a corner-use reaction force receiver that forms a replacement face that substitutes as a part of the outer side wall of a curved portion at which the first tunnel is curved.

4. The tunnel excavation method according to claim 1, wherein in the first excavation step, a second auxiliary tunneling apparatus is disposed that comprises a corner-use reaction force receiver that forms a replacement face that substitutes as a part of an outer side wall of a curved portion at which the first tunnel is curved.

5. A tunnel excavation method in which a tunnel is excavated using a boring machine that performs excavation by rotating a cutter head in a state in which a gripper is pressed against a side wall, the method comprising:

a first excavation step of excavating a first tunnel;

a preparation step of preparing a replacement face to substitute as a part of a side wall of a second tunnel at a planned intersection portion between the first tunnel and the second tunnel;

a relocation step of relocating the replacement face to the planned intersection portion of the first tunnel, and using the replacement face as part of the side wall of the second tunnel; and a second excavation step of excavating the second tunnel by using the boring machine, and pushing of the gripper against the replacement face and excavating at the planned intersection portion.

6. The tunnel excavation method according to claim 5, wherein the first tunnel includes at least three sections that are substantially parallel to each other.

7. The tunnel excavation method according to claim 6, wherein the substantially parallel sections are linked by curved sections, resulting in a continuous first tunnel.

8. The tunnel excavation method according to claim 5, wherein the second tunnel includes at least three sections that are substantially parallel to each other.

9. The tunnel excavation method according to claim 8, wherein the substantially parallel sections are linked by curved sections, resulting in a continuous second tunnel.

* * * * *